US010232522B1

(12) United States Patent
Chang

(10) Patent No.: US 10,232,522 B1
(45) Date of Patent: Mar. 19, 2019

(54) CIRCULAR CUTTER

(71) Applicant: DONWEI MACHINERY IND. CO., LTD., Taichung (TW)

(72) Inventor: Pi-Chao Chang, Taichung (TW)

(73) Assignee: DONWEI MACHINERY IND. CO., LTD., Taichung (TW)

( * ) Notice: Subject to any disclaimer, the term of this patent is extended or adjusted under 35 U.S.C. 154(b) by 0 days.

(21) Appl. No.: 15/689,749

(22) Filed: Aug. 29, 2017

(51) Int. Cl.

| | |
|---|---|
| ***B26B 29/06*** | (2006.01) |
| ***B26B 3/00*** | (2006.01) |
| ***B26D 1/00*** | (2006.01) |
| ***B26B 25/00*** | (2006.01) |
| *B26D 7/22* | (2006.01) |

(52) U.S. Cl.
CPC ..... *B26B 25/005* (2013.01); *B26D 7/22* (2013.01)

(58) Field of Classification Search
CPC ..... B26B 29/06; B26B 25/005; B43L 12/00; B43L 7/005; Y10T 83/04; Y10T 83/8763
USPC ..... 30/292, 319, 2, 151, 161, 162, 286, 288, 30/306, 307, 329, 340; D7/694; D8/98
See application file for complete search history.

(56) References Cited

U.S. PATENT DOCUMENTS

| | | | | |
|---|---|---|---|---|
| 4,601,103 | A * | 7/1986 | Sugiyama | B26B 25/005 30/162 |
| 5,299,355 | A * | 4/1994 | Boda | B26B 5/003 30/162 |
| 6,094,824 | A * | 8/2000 | Takeshita | B26B 25/005 30/276 |
| 2005/0086811 | A1* | 4/2005 | Kawasaki | B26B 29/00 30/162 |
| 2011/0078908 | A1* | 4/2011 | Bagley | B26B 29/06 30/292 |

* cited by examiner

*Primary Examiner* — Ghassem Alie

(57) ABSTRACT

A circular cutter contains: a connection assembly having a first extension and a first fixing head. The first fixing head has a locking hole. The first extension has a cavity, a first groove, and a second groove. The cavity accommodates a protection assembly which has a second extension and a second fixing head, wherein the second extension has a projection and a flexible deformation section connecting with the projection, the flexible deformation section deforms, and the projection retains in the second groove of the connection assembly. An elongated section is defined between the flexible deformation section and the second fixing head and is fixed in the first groove, the second fixing head has a first orifice corresponding to the locking hole of the connection assembly, such that a fixing assembly is rotatably connected with a cutting blade and is fixed in the locking hole.

7 Claims, 8 Drawing Sheets

CIRCULAR CUTTER

FIELD OF THE INVENTION

The present invention relates to a circular cutter in which the connection assembly drives the cutting blade to push the rotatable disc away by way of the flexible deformation section and the elongated section of the protection assembly, hence the cutting blade cuts the object at any angles.

BACKGROUND OF THE INVENTION

A conventional circular cutter contains a cutting blade configured to cut an object after pushing the cutting blade, and the cutting blade is retracted after cutting the object. However, this conventional circular cutter is complicated and cuts the object troublesomely.

Another conventional circular cutter contains a protection assembly fixed aside a cutting blade and abutting against a spring, when the protection assembly is not forced by an external force, it is located on one side of the cutting blade so as to avoid cutting the user. When the protection assembly is forced by the external force, the spring deforms so that the protection assembly moves and the cutting blade exposes to cut the object. However, this conventional circular cutter has high production cost. Furthermore, the protection assembly and the spring are two independent components respectively, so they are damaged easily.

The present invention has arisen to mitigate and/or obviate the afore-described disadvantages.

SUMMARY OF THE INVENTION

The primary objective of the present invention is to provide a circular cutter in which the connection assembly drives the cutting blade to push the rotatable disc away by way of the flexible deformation section and the elongated section of the protection assembly, hence the cutting blade cuts the object at any angles.

To obtain above-mentioned objective, a circular cutter provided by the present invention contains: a connection assembly including a first extension and a first fixing head connecting with one end of the first extension, and the first fixing head having a locking hole defined on the first fixing head.

The first extension has a cavity formed on one side of the first extension, a first groove defined on a first end of the cavity, and a second groove defined on a second end of the cavity.

The cavity accommodates a protection assembly, and the protection assembly includes a second extension and a second fixing head connecting with one end of the second extension, wherein the second extension has a projection and a flexible deformation section connecting with the projection, the flexible deformation section deforms, and the projection retains in the second groove of the connection assembly.

In addition, an elongated section is defined between the flexible deformation section and the second fixing head and is fixed in the first groove, the second fixing head has a first orifice corresponding to the locking hole of the connection assembly, hence a fixing assembly is rotatably connected with a cutting blade and is fixed in the locking hole of the connection assembly.

DETAILED DESCRIPTION OF THE PREFERRED EMBODIMENTS

Figure 1:
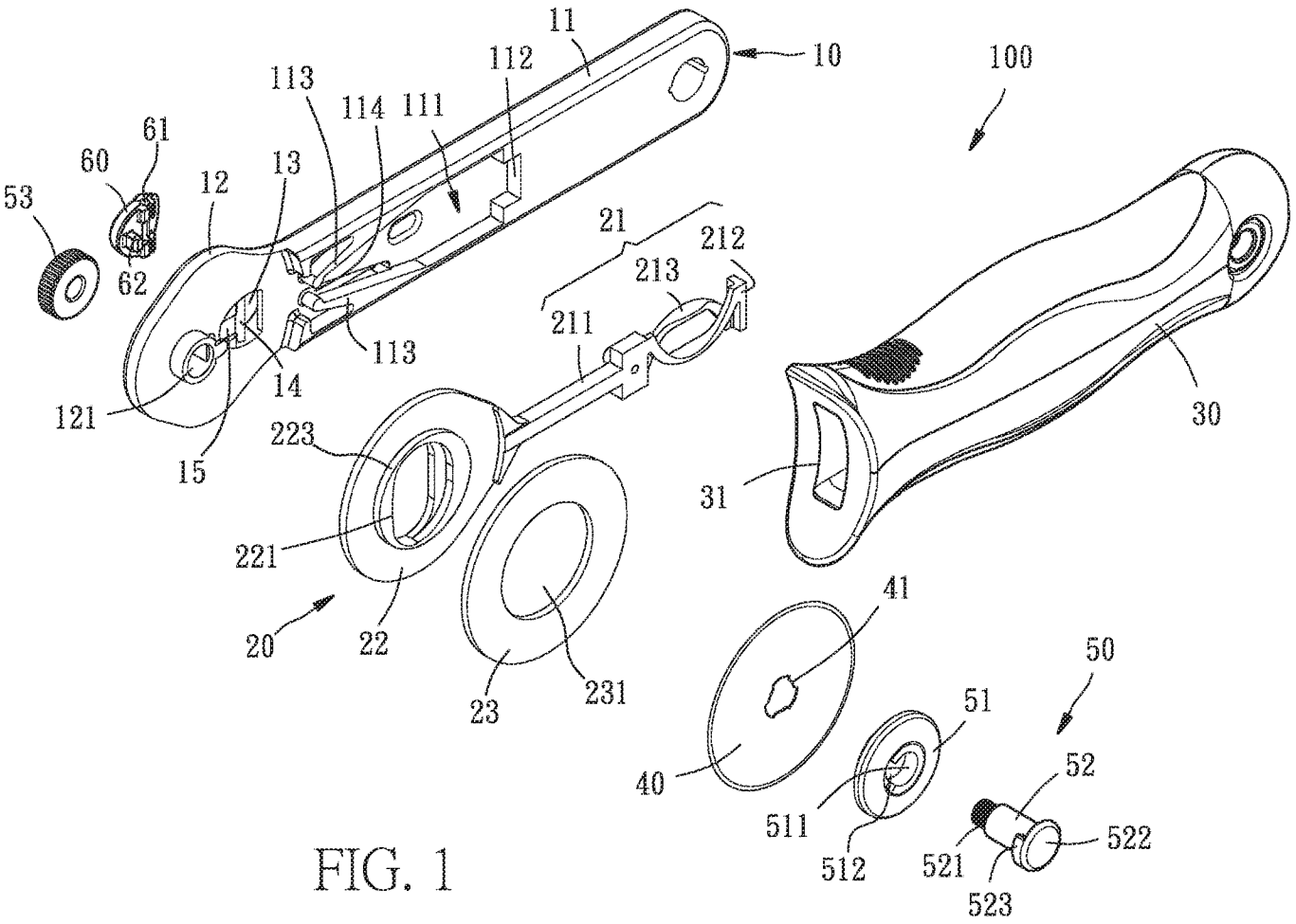
FIG. 1 is a perspective view showing the exploded components of a circular cutter according to a preferred embodiment of the present invention.
Figure 2:
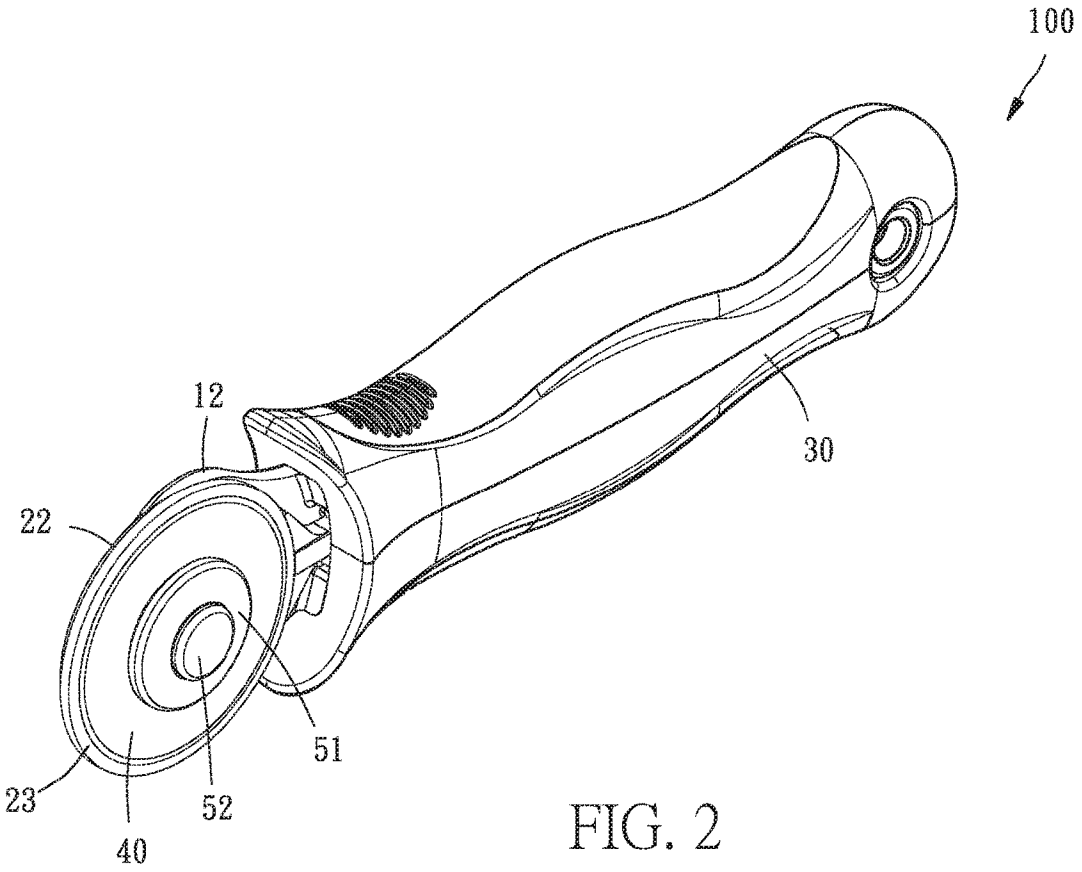
FIG. 2 is a perspective view showing the assembly of the circular cutter according to the preferred embodiment of the present invention.
Figure 3:
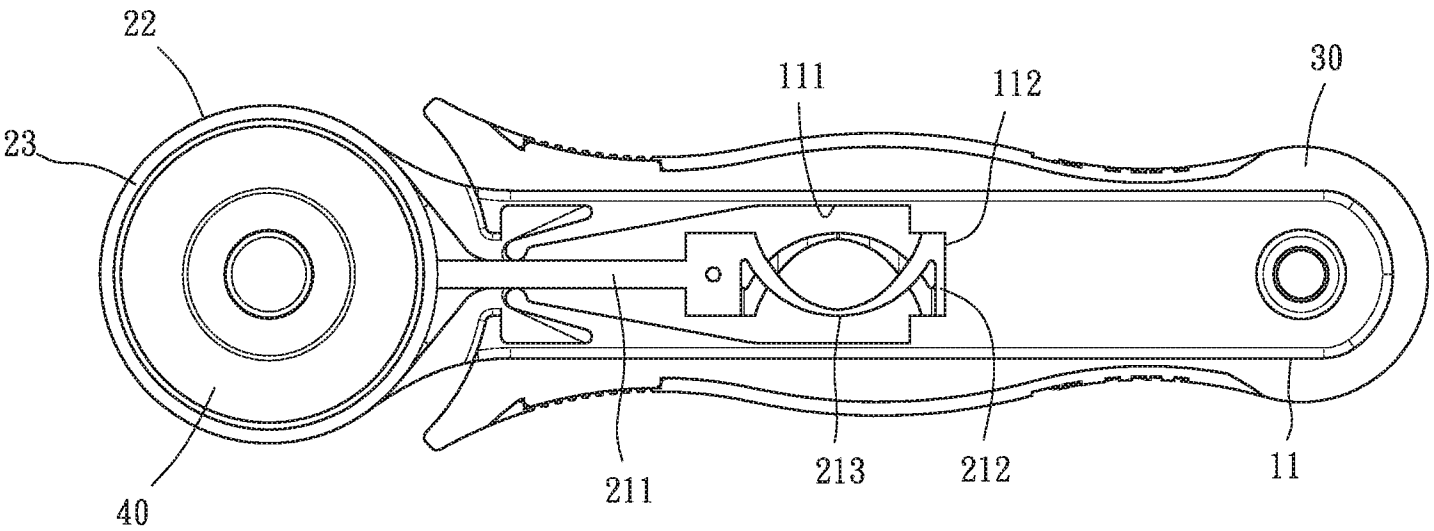
FIG. 3 is a side plan view showing the assembly of the circular cutter according to the preferred embodiment of the present invention.

With reference to FIGS. 1-7, a circular cutter 100 according to a preferred embodiment of the present invention comprises: a connection assembly 10, a protection assembly 20, a handle grip 30, a cutting blade 40, a fixing assembly 50, and a safety button 60.

Referring to FIGS. 1-4, the connection assembly 10 includes a first extension 11 and a first fixing head 12 connecting with one end of the first extension 11, wherein the first fixing head 12 has a locking hole 121 defined thereon.

The first extension 11 has a cavity 111 formed on one side thereof, a first groove 114 defined on a first end of the cavity 111, two flexible actuation stems 113 symmetrically arranged beside two sides of the first groove 114 separately, and a second groove 112 defined on a second end of the cavity 111.

The protection assembly 20 is accommodated in the cavity 111 and includes a second extension 21 and a second fixing head 22 connecting with one end of the second extension 21, wherein the second extension 21 has an elongated section 211 coupling with the second fixing head 22, a projection 212, and a flexible deformation section 213 defined between the elongated section 211 and the projection 212, wherein the elongated section 211 is fixed in the first groove 114 and is flexible so as to incline after being pushed by an external force.

The flexible deformation section 213 is accommodated in the cavity 111 and is comprised of two arcuate parts, such that the flexible deformation section 213 deforms after being pushed by the external force. The projection 212 is retained in the second groove 112 of the first extension 11, and the second fixing head 22 has a first orifice 221, a second orifice 222, a contacting rib 223 extending outwardly from a peripheral side of the first orifice 221 and rotatably connecting with a guiding aperture 231 of a rotatable disc 23, wherein an outer diameter of the rotatable disc 23 is more than that of the first fixing head 12, and a diameter of the first orifice 221 is more than that of the locking hole 121.

As shown in FIGS. 1-4, the handle grip 30 includes an accommodation hole 31 defined therein so as to house the first extension 11 of the connection assembly 10 and the second extension 21 of the protection assembly 20, and the handle grip 30 is gripped by a user.

As illustrated in FIGS. 1-4, the cutting blade 40 is circular and includes a positioning hole 41 corresponding to the guiding aperture 231 of a rotatable disc 23, wherein the cutting blade 40 abuts against the rotatable disc 23, and an outer diameter of the cutting blade 40 is less than that of the rotatable disc 23.

With reference to FIGS. 1-4, the fixing assembly 50 includes a washer 51, a screw bolt 52, and a nut 53, wherein the washer 51 has a through hole 511 and a recess 512 adjacent to the through hole 511, the screw bolt 52 has a stem 521 and a circular tab 522 coupling with the stem 521, hence the stem 521 screws with the nut 53 via the through hole 511 of the washer 51, the positioning hole 41 of the cutting blade 40, the first orifice 221 of the protection assembly 20, and the locking hole 121 of the connection assembly 10. The washer 51 contacts with the cutting blade 40, the nut 53 is mounted on the first fixing head 12, and the circular tab 522 has a protrusion 523 extending outwardly therefrom and retained in the recess 512 of the washer 51.

Referring to FIGS. 1-5, the safety button 60 includes a rotatable coupling portion 61 and a knob 62, and the first fixing head 12 of the connection assembly 10 has a connecting portion 13 in which a column 14 and a notch 15 are arranged, wherein the column 14 is rotatably connected with the rotatable coupling portion 61 of the safety button 60, the notch 15 accommodates the knob 62, and the knob 62 of the safety button 60 is urged by the external force to movably engage with or remove from the second orifice 222. When the knob 62 of the safety button 60 is movably removed from the second orifice 222, the rotatable disc 23 of the protection assembly 20 is forced by the external force to move, and the cutting blade 40 exposes outside the rotatable disc 23. When the knob 62 of the safety button 60 is movably engaged with the second orifice 222, the protection assembly 20 is not driven by the external force so that the rotatable disc 23 abuts against the cutting blade 40.

Figure 5:
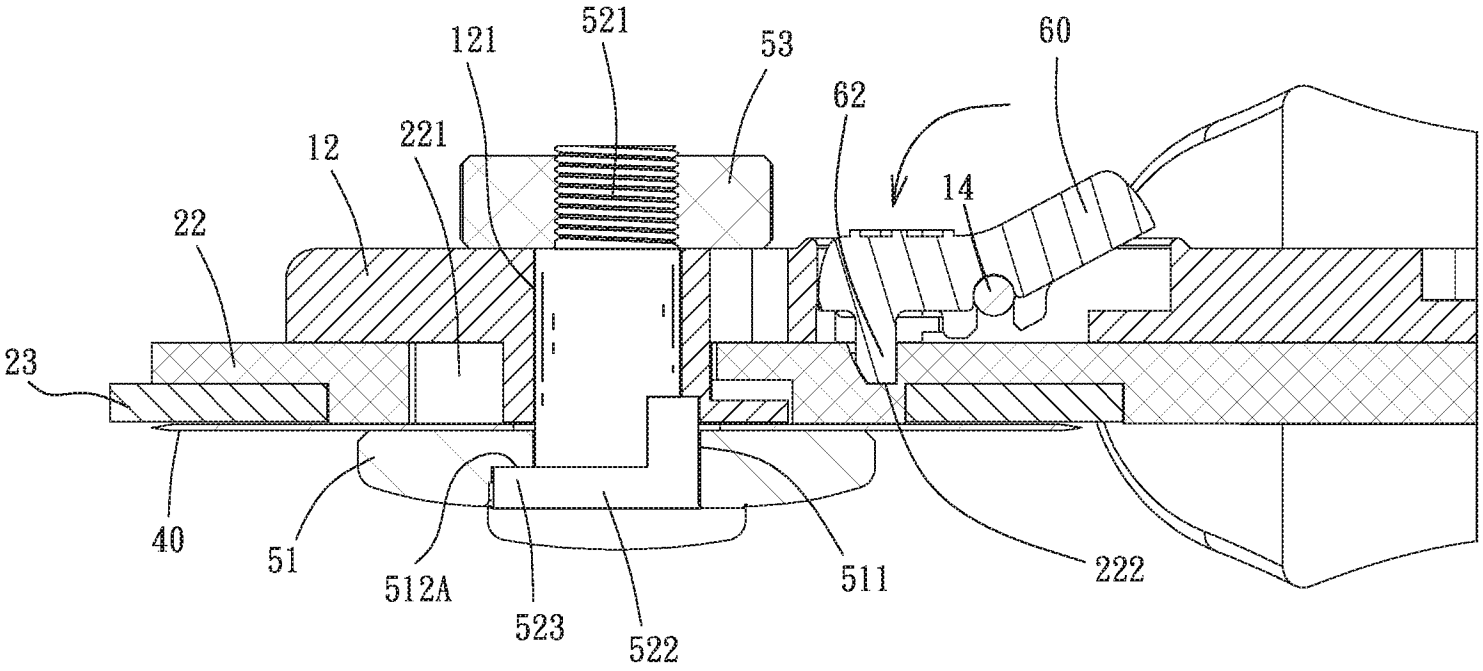
FIG. 5 is another cross sectional view showing the operation of a part of the circular cutter according to the preferred embodiment of the present invention.

Thereby, when the circular cutter 100 is not used, the safety button 60 is moved toward a locking position so that the knob 62 of the safety button 60 is movably engaged with the second orifice 222 of the second fixing head 22 (as shown in FIG. 5), and the protection assembly 20 is not forced by the external force to deform, so that the rotatable disc 23 abuts against the cutting blade 40. Furthermore, the outer diameter of the rotatable disc 23 is more than that of the cutting blade 40, so the rotatable disc 23 abuts against the cutting blade 40 so as to avoid the cutting blade 40 cutting the user. Preferably, the rotatable disc 23 smoothly rotates on an object.

Figure 4:
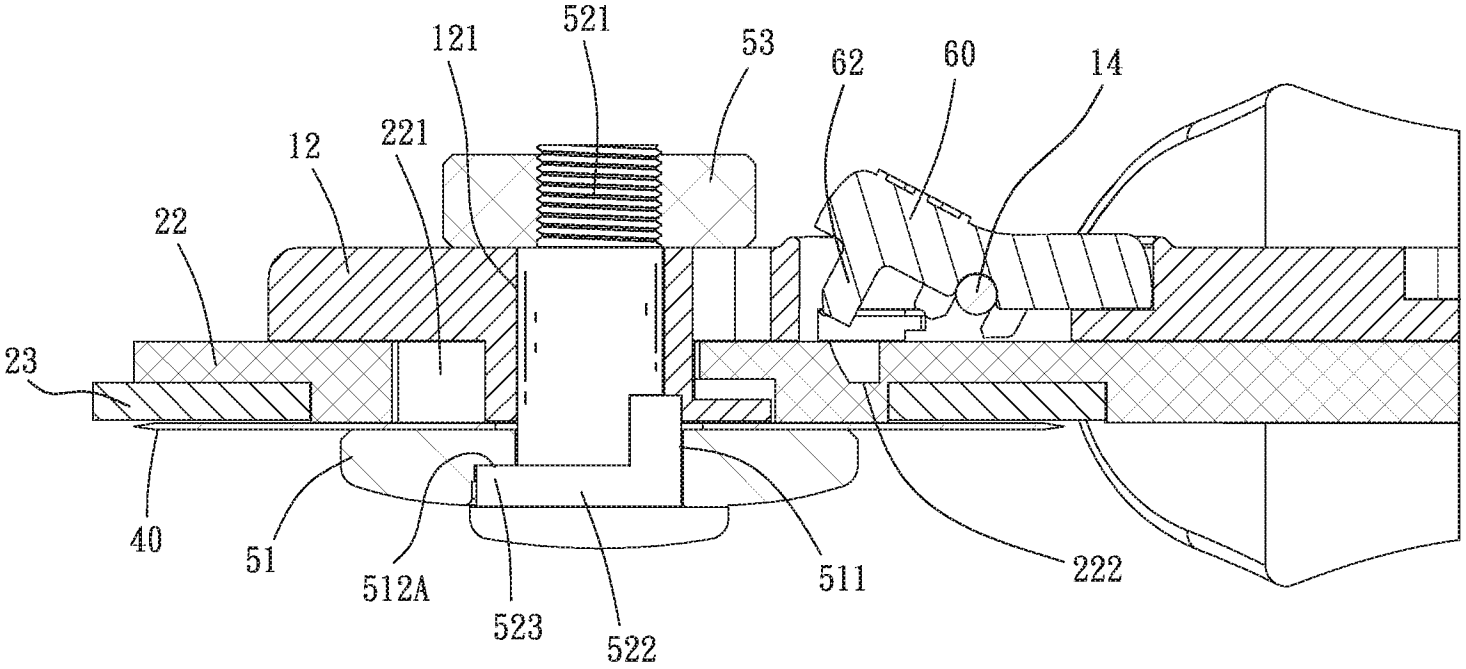
FIG. 4 is a cross sectional view showing the operation of a part of the circular cutter according to the preferred embodiment of the present invention.
Figure 6:
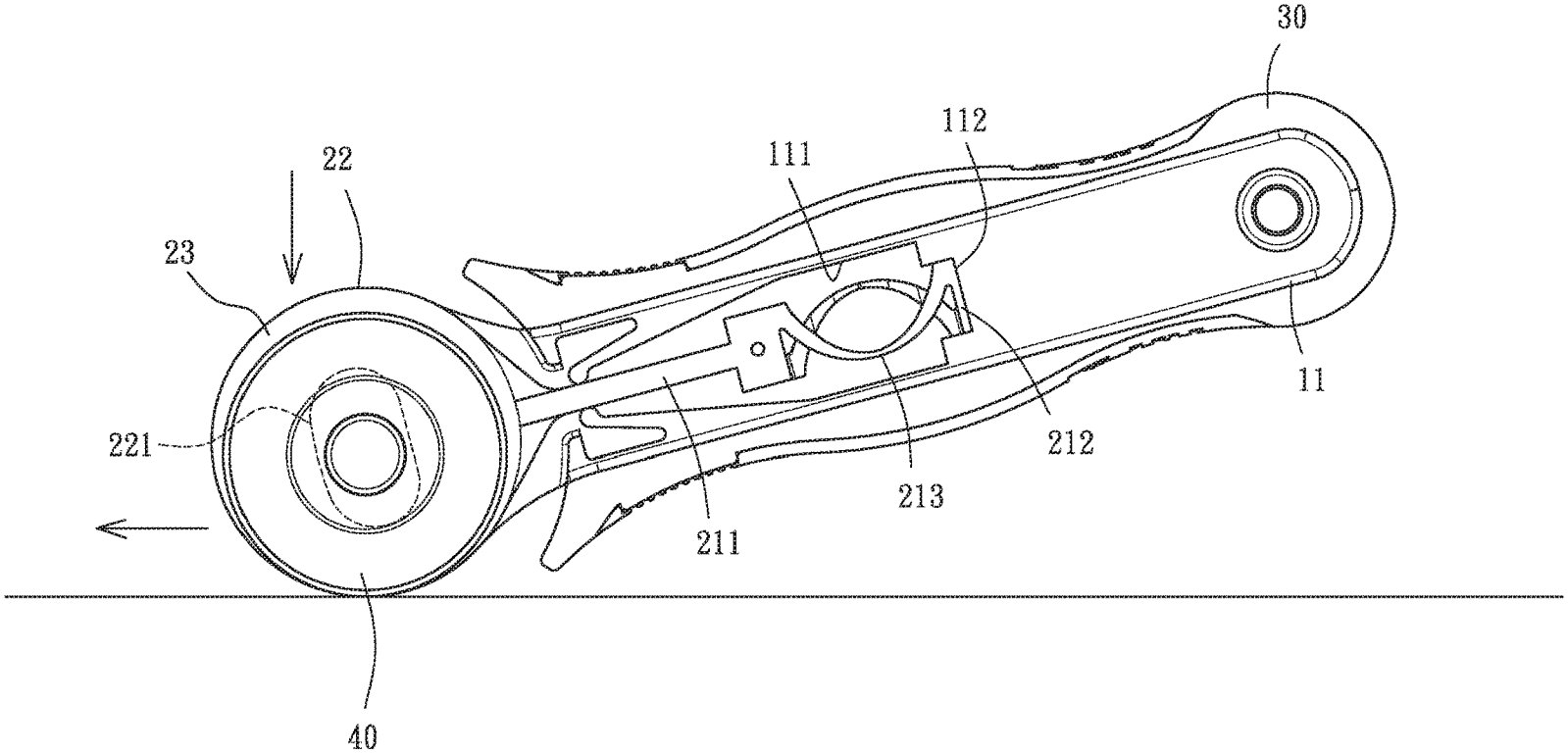
FIG. 6 is a side plan view showing the operation of the operation of the circular cutter according to the preferred embodiment of the present invention.

When the circular cutter 100 is used, the safety button 60 is moved toward an unlocking position so that the knob 62 of the safety button 60 is movably removed from the second orifice 222 of the second fixing head 22 (as shown in FIG. 4), such that the protection assembly 20 is not limited by the safety button 60 and is forced by the external force to deform the flexible deformation section 213, and the rotatable disc 23 is pushed away so that the cutting blade 40 exposes outside the rotatable disc 23 (as illustrated in FIG. 6) to cut the object.

Figure 7:
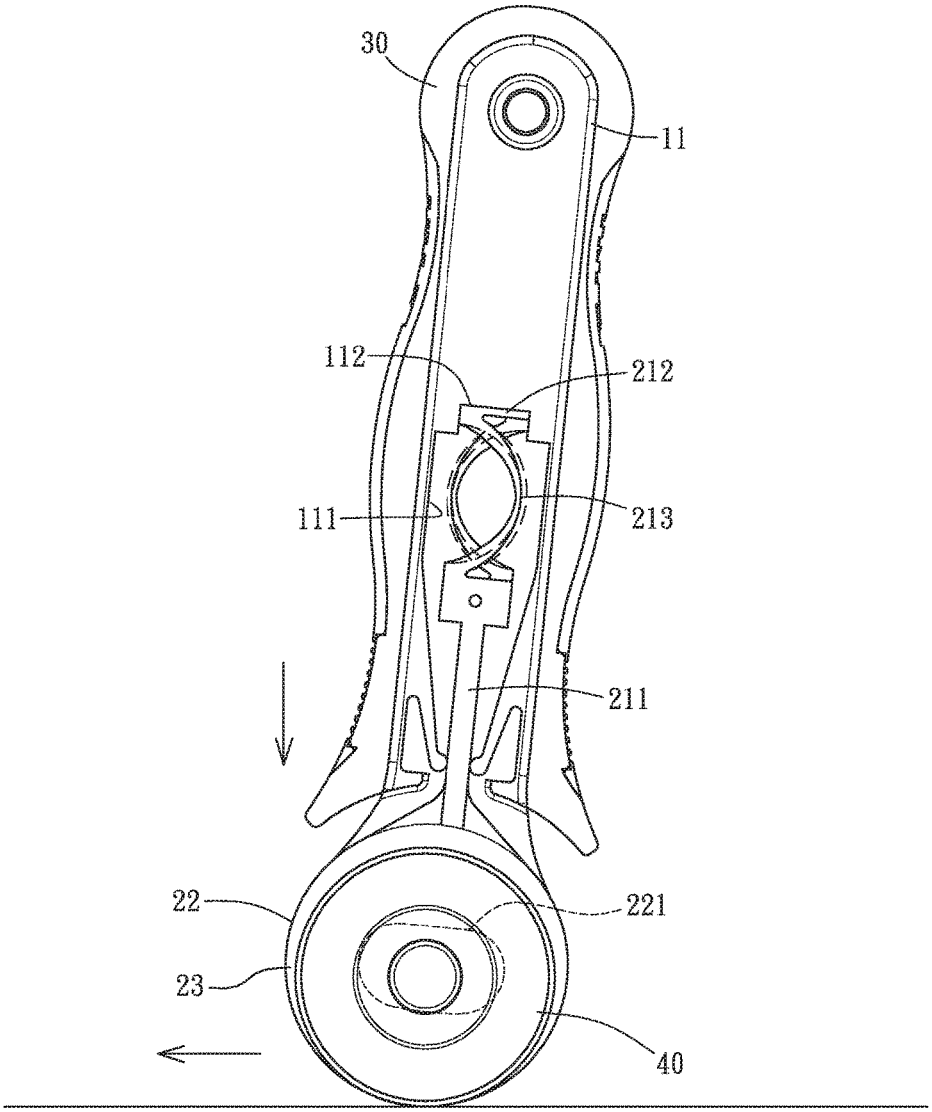
FIG. 7 is another side plan view showing the operation of the operation of the circular cutter according to the preferred embodiment of the present invention.
Figure 8:
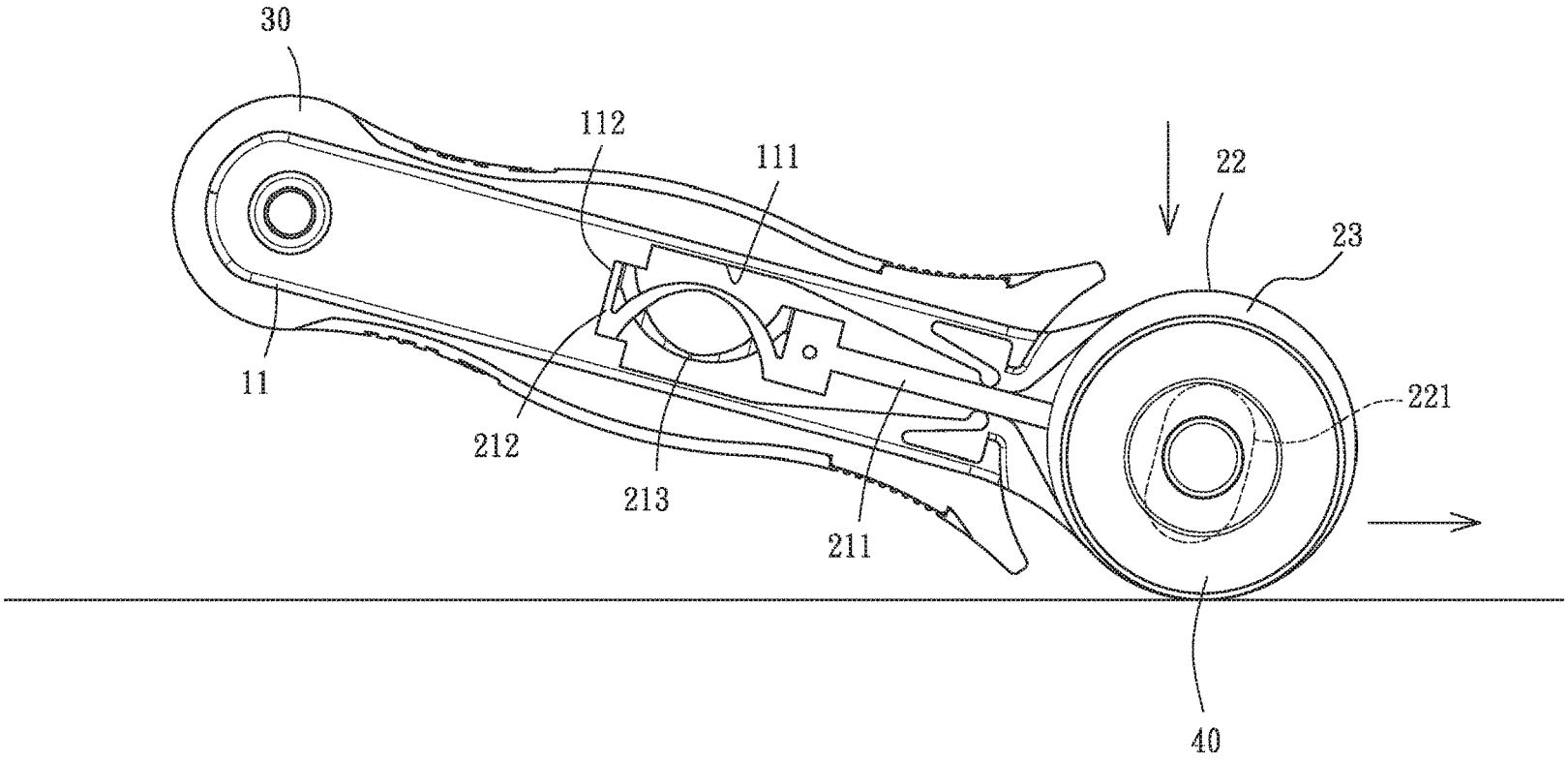
FIG. 8 is also another side plan view showing the operation of the operation of the circular cutter according to the preferred embodiment of the present invention.

Accordingly, the connection assembly 10 drives the cutting blade 40 to push the rotatable disc 23 away by way of the flexible deformation section 213 and the elongated section 211 of the protection assembly 20, hence the cutting blade 40 cuts the object (as shown in FIGS. 6-8) at any angles.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A circular cutter comprising:

a connection assembly including a first extension and a first fixing head connecting with one end of the first extension, and the first fixing head having a locking hole defined on the first fixing head;

wherein the first extension has a cavity formed on one side of the first extension, a first groove defined on a first end of the cavity, and a second groove defined on a second end of the cavity;

wherein the cavity accommodates a protection assembly, and the protection assembly includes a second extension and a second fixing head connecting with one end of the second extension, wherein the second extension has a projection and a flexible deformation section connecting with the projection, the flexible deformation section deforms, and the projection retains in the second groove of the connection assembly;

wherein an elongated section is defined between the flexible deformation section and the second fixing head and is fixed in the first groove, the second fixing head has a first orifice corresponding to the locking hole of the connection assembly, hence a fixing assembly is rotatably connected with a cutting blade and is fixed in the locking hole of the connection assembly;

wherein the second fixing head has a contacting rib extending outwardly from a peripheral side of the first orifice and rotatably connecting with a guiding aperture of a rotatable disc, wherein an outer diameter of the rotatable disc is more than that of the first fixing head.

2. The circular cutter as claimed in claim 1, wherein a handle grip houses the first extension of the connection assembly and the second extension of the protection assembly, and the handle grip includes an accommodation hole configured to accommodate the first extension of the connection assembly and the second extension of the protection assembly.

3. The circular cutter as claimed in claim 1, wherein the flexible deformation section is comprised of two arcuate parts which are flexible and are forced to deform.

4. The circular cutter as claimed in claim 1, wherein a diameter of the first orifice is more than that of the locking hole.

5. The circular cutter as claimed in claim 1, wherein the cutting blade includes a positioning hole, and the fixing assembly includes a washer, a screw bolt, and a nut, wherein the washer has a through hole and a recess adjacent to the through hole, the screw bolt has a stem and a circular tab coupling with the stem, hence the stem screws with the nut via the through hole, the positioning hole, the first orifice, and the locking hole; the circular tab has a protrusion extending outwardly therefrom and retained in the recess of the washer.

6. The circular cutter as claimed in claim 1 further comprising a safety button including a rotatable coupling portion and a knob, and the first fixing head of the connection assembly having a connecting portion in which a column and a notch are arranged, wherein the column is rotatably connected with the rotatable coupling portion of the safety button, the notch accommodates the knob, and the second fixing head has a second orifice; the knob of the safety button is urged by an external force to movably engage with or remove from the second orifice; when the knob of the safety button is movably removed from the second orifice, the protection assembly is forced by the external force to move, and the cutting blade exposes outside the second fixing head; when the knob of the safety button is movably engaged with the second orifice, the protection assembly is not driven by the external force so as to abut against the cutting blade.

7. The circular cutter as claimed in claim 1, wherein the first extension further has two flexible actuation stems symmetrically arranged beside two sides of the first groove separately.

* * * * *